United States Patent [19]

Kitamura et al.

[11] Patent Number: 4,469,767

[45] Date of Patent: Sep. 4, 1984

[54] ELECTROPHOTOGRAPHIC PROCESS CAPABLE OF IMAGE OVERPLAY AND APPARATUS THEREFOR

[75] Inventors: Takashi Kitamura, Yokohama; Michio Ito, Hachioji, both of Japan

[73] Assignee: Canon Kabushiki Kaisha, Tokyo, Japan

[21] Appl. No.: 339,602

[22] Filed: Jan. 15, 1982

Related U.S. Application Data

[63] Continuation of Ser. No. 104,706, Dec. 17, 1979, abandoned.

[30] Foreign Application Priority Data

| | | | |
|---|---|---|---|
| Dec. 26, 1978 | [JP] | Japan | 53-161401 |
| Dec. 26, 1978 | [JP] | Japan | 53-161403 |
| Dec. 26, 1978 | [JP] | Japan | 53-161405 |
| Dec. 26, 1978 | [JP] | Japan | 53-161407 |

[51] Int. Cl.[3] ..... G03G 13/052; G03G 13/24

[52] U.S. Cl. ..... 430/31; 430/54; 430/55; 430/67; 430/100

[58] Field of Search ..... 430/54, 55, 67, 31, 430/100

[56] References Cited

U.S. PATENT DOCUMENTS

| | | | |
|---|---|---|---|
| 3,615,395 | 10/1971 | Yamaji et al. | 430/54 |
| 3,871,878 | 3/1975 | Mino | 430/54 |
| 4,071,361 | 1/1978 | Marushima | 430/54 |
| 4,311,778 | 1/1982 | Kadowaki et al. | 430/54 |
| 4,329,413 | 5/1982 | Kitamura et al. | 430/54 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

This invention provides a process for making image overlay through the steps constituting an electrophotographic process, and also an apparatus adapted for conducting such process. The process, based on an electrophotographic process utilizing a three-layered photosensitive member having an insulating cover layer, comprising exposing the photosensitive member to a first image-forming irradiation to be overlaid substantially simultaneously with or subsequent to a charging on the surface of the insulating layer, then exposing the photosensitive member to a second image-forming irradiation to be overlaid substantially simultaneously with an AC or DC corona discharge given to the photosensitive member, and subsequently giving a uniform exposure to the surface of said photosensitive member thereby obtaining an electrophotographic overlay image of the first and second irradiations.

12 Claims, 34 Drawing Figures

ELECTROPHOTOGRAPHIC PROCESS CAPABLE OF IMAGE OVERPLAY AND APPARATUS THEREFOR

This is a continuation of application Ser. No. 104,706, filed Dec. 17, 1979, now abandoned.

BACKGROUND OF THE INVENTION

1. Field of the Invention

The present invention relates to an electrophotographic process capable of forming an overlay image from a first image and a second image.

2. Description of the Prior Art

In the field of electrophotography there are already known various systems such as electrofax system, xerox system, P.I.P. (persistent internal polarization) system and NP system which is disclosed for example in the U.S. Pat. Nos. 3,666,363 and 4,071,361 and in German Pat. Nos. 1,522,567 and 1,522,568. The electrofax and xerox systems depends upon so-called Carlson process as described in the U.S. Pat. No. 2,297,691 wherein a layer of a photoconductive material such as zinc oxide (for electrofax system) or amorphous selenium (for xerox system) provided on a substrate is uniformly charged with a corona discharge and then subjected to an imagewise exposure to light to dissipate the charge in the exposed area, and an electrostatic image thus obtained corresponding to the original pattern is rendered visible by development with charged colored particles and fixed on said layer or after transfer onto another support material such as a paper sheet to obtain an electrophotographic image. The P.I.P. system utilizes the physical properties, i.e. persistent internal polarization and photoconductivity for forming a latent image. Also the NP system utilizes the photoconductivity and electrostatic capacitance of a photoconductive layer and an insulating layer provided thereon for forming an electrostatic latent image, which is subsequently subjected to the steps of development, transfer and fixing in a similar manner to obtain an electrophotographic image.

Although various copying apparatuses have been developed on these electrophotographic processes, such apparatus have been unable to satisfactorily meet, except to a limited extent, the increasing demand for exposing plural different originals onto a photosensitive member to obtain an overlaid latent image and thus to obtain an overlaid visible image. Also, the prior image overlay processes principally depend on optical overlay of plural images or on electrically overlaid signals, and there have been very few known overlay processes for forming an overlay image on a photosensitive member by combining different steps constituting an electrophotograpic process.

An example of such a known overlay process utilizing the above-mentioned NP system is disclosed in the U.S. Pat. No. 4,122,462 assigned to the assignee of the present application. The present invention provides another overlay process and an apparatus adapted therefor.

SUMMARY OF THE INVENTION

The object of the present invention is to provide a simple image overlay process capable of satisfying the above-mentioned demand through the combination of steps constituting an electrophotographic process, and an apparatus adapted for conducting such process.

Another object of the present invention is to provide a process, and an apparatus adapted for conducting the same, for forming an overlaid electrostatic latent image from first and second images through an electrophotographic process utilizing a three-layered photosensitive member having an insulating cover layer by exposing said photosensitive member to a first image-forming irradiation to be overlaid substantially simultaneously with or subsequent to a charging on the surface of said insulating layer, then exposing said photosensitive member to a second image-forming irradiation to be overlaid substantially simultaneously with a corona discharge, and subsequently giving a uniform exposure to the entire surface of said photosensitive member.

In a preferred embodiment, the present invention is featured by an electrophotographic process and an apparatus therefor utilizing a photosensitive member essentially composed of a conductive substrate, a photoconductive layer and an insulating layer and comprising the steps of exposing said photosensitive member to a first image-forming irradation substantially simultaneously with a charging onto the surface of said insulating layer, then exposing said photosensitive member to a second image-forming irradiation substantially simultaneously with an AC charge elimination, and uniformly exposing the entire surface of said insulating layer to light to obtain an overlaid electrostatic latent image of said first and second irradiations.

In another preferred embodiment, the present invention features an electrophotographic process and an apparatus therefor utilizing a photosensitive member essentially composed of a conductive substrate, a photoconductive layer and an insulating layer and comprising the steps of exposing said photosensitive member to a first image-forming irradiation substantially simultaneous with a charging onto the surface of said insulating layer, then exposing said photosensitive member to a second image-forming irradiation, substantially simultaneous with a charging of opposite polarity, and uniformly exposing the entire surface of said insulating layer to light to obtain an overlaid electrostatic latent image of said first and second irradiations.

In still another preferred embodiment, the present invention features an electrophotographic process and an apparatus therefor utilizing a photosensitive member essentially composed of a conductive substrate, a photoconductive layer and an insulating layer, and comprising the steps of charging the surface of said insulating layer, then exposing said photosensitive member to a first image-forming irradiation, then exposing said photosensitive member to a second image-forming irradiation, substantially simultaneous with an AC charge elimination and uniformly exposing the entire surface of said insulating layer to light to obtain an overlaid electrostatic latent image of said first and second irradiations.

In still another preferred embodiment, the present invention features an electrophotographic process and an apparatus therefor utilizing a photosensitive member essentially composed of a conductive substrate, a photoconductive layer and an insulating layer, and comprising the steps of charging the surface of said insulating layer, then exposing said photosensitive member to a first image-forming irradiation, then exposing said photosensitive member to a second image-forming irradiation, substantially simultaneous with a charging of opposite polarity and uniformly exposing the entire surface of said insulating layer to light to obtain an overlaid electrostatic latent image of said first and second irradiations.

Also in the foregoing preferred embodiments, the present invention further features an electrophotographic process and an apparatus therefor for forming an overlaid electrostatic latent image, wherein said first and second irradiations are positionally registered.

In the general embodiment of the electrophotographic process of the present invention, a photosensitive member essentially composed of a conductive substrate, a photoconductive layer and an insulating layer is exposed to a first light image substantially simultaneous with or immediately after a positive or negative charging of the surface of said insulating layer, then is exposed to a second light image substantially simultaneous with an AC charge elimination or a charging of a polarity opposite to that of the above-mentioned first charging of the surface of said insulating layer, and is finally exposed to uniformly light over the entire surface of said photosensitive member to create a difference between the surface potential, or an area corresponding both to the lighted area of said first image and to the dark area of said second image and the surface potential of the other area, thereby forming an overlaid latent image of said first and second images. The electrostatic image thus obtained is rendered visible by the development with a developer principally consisting of charged colored particles. The thus obtained visible image is then transferred onto a transfer material such as a paper sheet by means of an internal or external electric field and thermally fixed with an infrared lamp or a hot plate to obtain an electrophotographic image. On the other hand, the photosensitive member is cleaned to remove the charged particles remaining on the surface of said insulating layer for repeated use in the imaging process.

Still other objects and advantages of the present invention will become apparent from the following description of the embodiments thereof to be taken in conjunction with the attached drawings.

DESCRIPTION OF THE PREFERRED EMBODIMENTS

Embodiment 1

Figure 1:
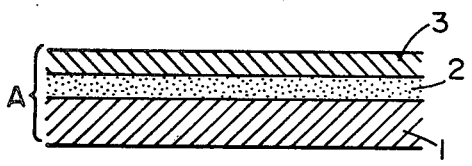
FIG. 1 is a schematic illustrative view of the structure of a photosensitive member adapted for use in the present invention.

Referring to FIG. 1 there is schematically shown a photosensitive member employed to form an electrostatic image, wherein 1 is an electroconductive substrate, 2 is a photoconductive layer which is provided on said conductive substrate 1, for example by spraying or coating with a coater or a wheeler, which may contain a small amount of binder such as a resin for improving the adhesion to other layers, and 3 is an insulating layer uniformly adhered onto said photoconductive layer 2. In this manner the photosensitive member A is essentially of three-layered structure composed of the conductive substrate, photoconductive layer and insulating layer, but it is also possible to add a control layer for limiting the charge displacement between the conductive substrate and the photoconductive layer and/or to add a charge trapping layer on the surface of said photoconductive layer or in the vicinity thereof. Also, the photoconductive property of the photosensitive member should preferably be such as to have a dark resistance as high as possible.

The conductive substrate 1 may be made of a metal such as tin, copper, aluminum, etc. or a hydroscopic paper, but can be conveniently made of paper laminated with an aluminum foil because of low cost and convenience for use in case of winding on a drum. The photoconductive layer may be composed of CdS, CdSe, crystalline Se, ZnO, ZnS, Se, $TiO_2$, SeTe, PbO or the mixtures thereof.

As certain photoconductive layers have a charge injection property causing the injection of charge of a particular polarity from the conductive substrate to the photoconductive layer at the step of electrostatic charging in the dark, the primary charging in the embodiments explained in the following is conducted with a polarity which does not cause such charge injection, in case said property of such photoconductive layer undesirably affects the charge distribution obtained by the first image exposure to be conducted substantially simultaneous or subsequent to said primary charging. However, the primary charging may be conducted at either polarity in case the photoconductive material employed has substantially no charge injection property or in case said property of the photoconductive material has substantially no effect on the charge distribution obtained by said first exposure.

The insulating layer 3 may be composed of a material satisfying the three requirements of a high abrasion resistance, a high resistance for maintaining the electrostatic charge thereon and a transparency, and can therefore be composed of a layer of fluorine resins, polycarbonate resins, polyethylene resins, cellulose acetate resins, polyester resins, etc. Among these fluorine resins are preferred in the embodiments of the present invention because of the easily cleanable characteristics thereof which facilitates the repeated use of the photosensitive member through the steps of development, image transfer and cleaning, as will be explained later.

Figure 2:
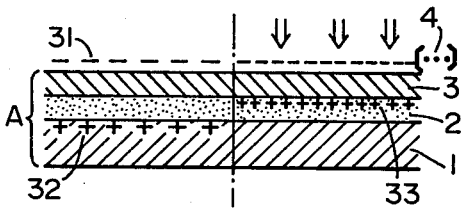
FIGS. 2 to 4 are explanatory views showing the steps of forming an overlaid latent image through exposures of first and second image-forming irradiation onto the photosensitive member shown in FIG. 1.
Figure 3:
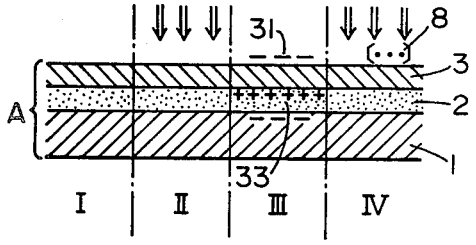
Figure 4:
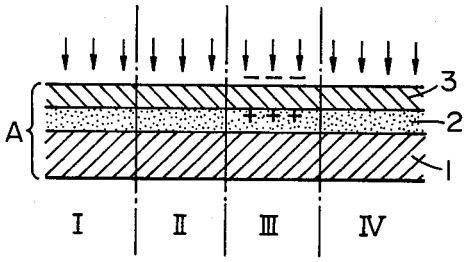

FIGS. 2 to 4 illustrate the steps of forming an overlaid latent image on the photosensitive member of the above-mentioned structure, and the charge patterns in said steps.

Referring to FIG. 2, the surface of the insulating layer 3 of the photosensitive member A is charged, for example negatively, by means of a corona discharger 4, and substantially simultaneously said member A is subjected to the exposure of a first light image. In this step, in a dark area a positive charge 32 is induced at the interface between the conductive substrate 1 and the photoconductive layer 2 or in a portion of said layer close to said interface, as the photoconductive layer 2 has a high resistance in this state. On the other hand in a lighted area wherein the photoconductive layer 2 is rendered electroconductive by the light stimulation, a positive charge is injected from the conductive substrate 1 and maintained at the interface between the photoconductive layer 2 and the insulating layer 3 by the attractive force of the surface charge on said insulating layer, as shown in FIG. 2. In this step the surface potential of the insulating layer 3 negatively increases with the charging time as shown by the curve Vp in FIG. 5.

Subsequently the surface of said insulating layer 3 is subjected to an AC corona discharge by an AC corona discharger 8 simultaneously with an exposure to a second light image, as shown in FIG. 3.

Corona discharger 4 and AC corona discharger 8 are preferably of an optically open structure having a transparent shield or without a shield in the top thereof in order to conduct the discharging operation substantially simultaneous with the exposure of light images.

In areas I, II corresponding to the dark area of the first light image, the negative charge 31 present on the surface of the insulating layer 3 is entirely or almost entirely dissipated because of the absence of any binding force.

Also in an area IV corresponding to the lighted area of the first image and also to the lighted area of the second image, the photoconductive layer 2 is rendered conductive by the light exposure to enable the positive charge 33 present at the interface between the photoconductive layer 2 and the insulating layer 3 to be released toward the conductive substrate 1, so that the negative charge 31 present on the surface of the insulating layer 3 loses the binding force and becomes entirely or almost entirely dissipated together with said positive charge 33. The amount of said dissipation depends upon the duration and intensity of the AC corona discharge.

However, in an area III corresponding to the lighted area of the first image and also to the dark area of the second image, the high resistance of the photoconductive layer 2 prevents the positive charge 33 maintained at said interface from being released toward the conductive substrate 1, whereby the negative charge 31 on the surface of the insulating layer 3 is bound by said positive charge 33 and is dissipated by the AC corona discharge only to an extent less than in the areas II and IV corresponding to the dark area of said first image or to the lighted area of said second image. In this manner a larger amount of negative charge is maintained in the area III corresponding to the lighted area of said first image and also to the dark area of said second image, but the external electric field resulting from the surface charge is extremely weak, since the large amount of positive charge 33 retained in the photoconductive layer 2 attracts the electric field generated by said surface charge, as shown in FIG. 3.

Subsequently the entire surface of the photosensitive member is exposed to light through the insulating layer 3 (or through the conductive substrate in case it is translucent) as shown in FIG. 4.

In this step, in the areas I, II and IV corresponding to the dark area of the first image or to the lighted area of the second image, the surface potential of the insulating layer 3 remains substantially zero as in the state shown in FIG. 3, since there is no substantial change in the charge distribution in the photoconductive layer 2. However in the area III corresponding to the lighted area of the first image and to the dark area of the second image, the photoconductive layer 2 which has been maintained in the high resistance state because of the absence of light exposure in the step of second image exposure reduces the resistance rapidly by the whole surface exposure, so that the positive charge 33 trapped in said layer is dissipated in the conductive substrate 1 same the amount corresponding to the negative charge 31 present on the surface of the insulating layer 3, whereby the external field resulting from said negative charge 31 being rapidly increased elevates the surface potential thereof as shown by the curve $V_{LD}$ in FIG. 5.

Figure 5:
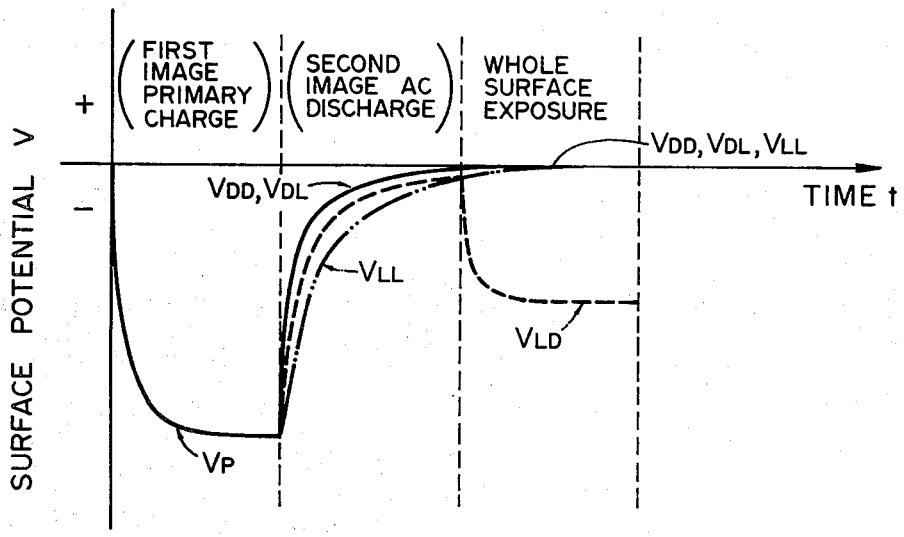
FIG. 5 is a chart schematically showing the change of the surface potential in the steps shown in FIGS. 2 to 4.

During the above-mentioned step, the surface potential of the insulating layer 3 shows the changes as shown in FIG. 5. The area III corresponding to the lighted area of the first image and also to the dark area of the second image alone shows a high potential $V_{LD}$, while other areas I, II and IV show the potentials $V_{DD}$, $L_{DL}$ and $V_{LL}$ approximately equal to zero.

Consequently it is rendered possible to obtain a visible overlay image of said first and second images by developing the photosensitive member A of the above-mentioned state with a toner material.

Figure 6:
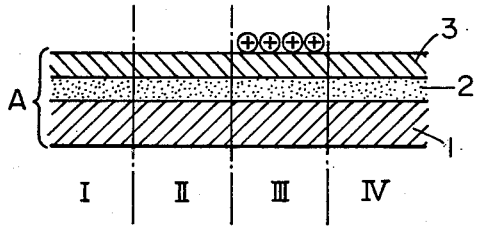
FIGS. 6 and 7 are explanatory views showing the steps of rendering the latent image visible.

FIG. 6 shows a state after development with a toner material of a polarity, positive in this case, opposite to that of the aforementioned primary charging, wherein the toner is deposited only on the area III corresponding to the lighted area of the first image and also to the dark area of the second image.

Figure 7:
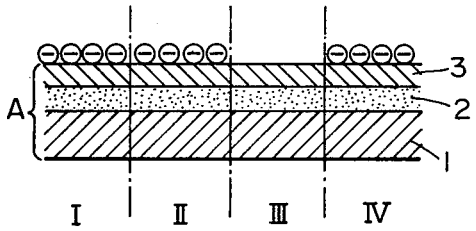

FIG. 7 shows a state of a reversal development with a toner material of a polarity, negative in this case, the same as that of the aforementioned primary charging, whereby the toner is deposited on the areas I, II and IV. In this case the developed image can be improved as already known by the use of a development electrode.

FIGS. 9 to 12 show various examples of overlay image formation, wherein (a) and (b) respectively represent the first and second original images wherein the hatched area stands for the image portion, while (c) and (d) respectively show the overlay images obtained with positive or negative toner development, wherein the hatched area stands for the toner deposited area. As will be apparent from these figures it is rendered possible to obtain various overlay images according to the patterns and polarity of said first and second original images.

Figure 8:
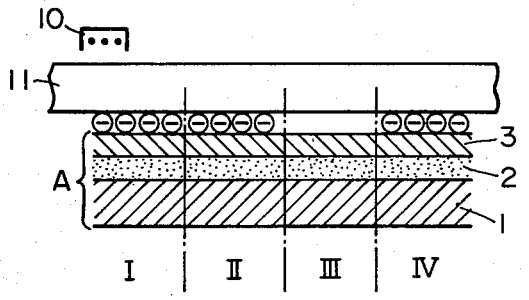
FIG. 8 is an explanatory view showing the step of transferring the visible image.
Figure 9A:
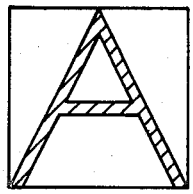
FIGS. 9 to 12 are views showing various examples of the patterns of the first and second images and of the overlaid visible image.
Figure 9B:
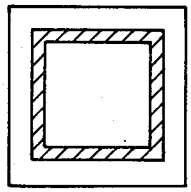
Figure 9C:
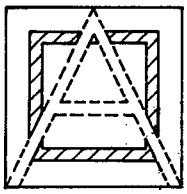
Figure 9D:
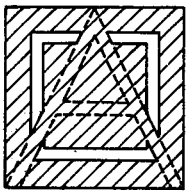
Figure 10A:
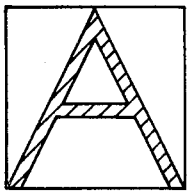
Figure 10B:
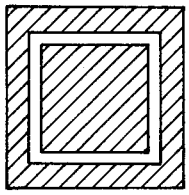
Figure 10C:
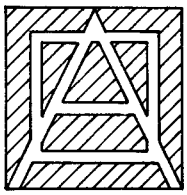
Figure 10D:
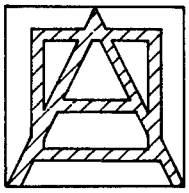
Figure 11A:
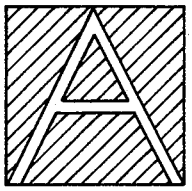
Figure 11B:
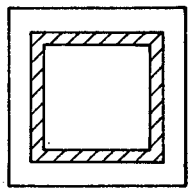
Figure 11C:
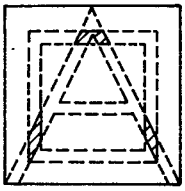
Figure 11D:
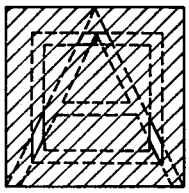
Figure 12A:
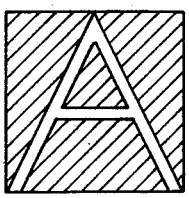
Figure 12B:
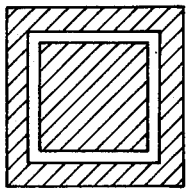
Figure 12C:
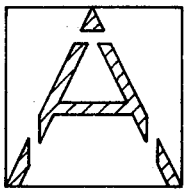
Figure 12D:
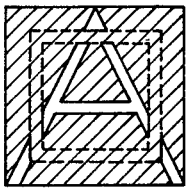

The visible image formed on the surface of said insulating layer 3 is subsequently transferred, under the infuluence of a corona discharge as shown in FIG. 8 or of a bias voltage, or by means of the internal electric field, onto a transfer material 11 such as a paper sheet and is finally fixed with an infrared lamp or a hot plate or by a pressure to obtain an electrophotographic visible image.

On the other hand the photosensitive member, after the image transfer is subjected to the cleaning of the surface of said insulating layer by a known cleaning method for eliminating the charged particles remaining on said surface, is thus prepared for repeated use in the imaging process. In this step the cleaning effect is increased if the charge constituting the electrostatic image on the surface of said insulating layer is eliminated, generally by a recharging prior to the cleaning. For this purpose the cleaning with an elastic blade or with a fur brush can be preceded by an AC corona discharge for eliminating the charge constituting said electrostatic image from the surface of said insulating layer. Also it is possible to facilitate the cleaning by providing such cleaning means with a potential of a polarity opposite to that of the charged particles.

The above-mentioned cleaning effect also depends upon the properties, particularly the adhesiveness, of the material constituting said insulating layer, and, among the aforementioned resins cited as suitable for constituting said layer, the fluorine resins are particularly advantageous, because of the low adhesive property thereof, in facilitating the removal of charged particles and thus allowing an enhanced cleaning effect.

For the purpose of achieving a satisfactory development, the electrostatic image should preferably have;

(1) a sufficiently large difference between the surface potential $V_{LD}$ and the potentials $V_{DD}$, $V_{DL}$ and $V_{LL}$; and (2) no difference among the potentials $V_{DD}$, $V_{DL}$ and $V_{LL}$.

In order to meet these requirements, it is necessary to suitably select the following factors:

(1) photoconductive material 2;

(2) amounts of first and second exposures;

(3) polarity and intensity of primary charging; and (4) intensity of AC corona discharge.

In the following there will be given a quantitative example of the electrostatic image forming process of the present invention.

100 grs. of cadmium sulfide activated with copper is added with 10 grs. vinyl chloride and mixed with a small amount of thinner to obtain a photosensitive material, which is coated in a thickness of ca. 50 microns on a surface-polished aluminum cylinder. Then an insulating layer of a thickness of 35 microns is laminated on the thus prepared photoconductive coating to obtain a photosensitive member. Said insulating layer is exposed to a corona discharge of +6.5 kV, and substantially simultaneously to a first light image with an intensity of ca. 12 lux for 0.3 seconds in the lighted area. Subsequently the photosensitive member is exposed to an AC corona discharge of 7.5 kV and substantially simultaneously to a second light image of the same intensity as mentioned above, and then the whole surface of the photosensitive member is uniformly exposed to a light of ca. 12 lux for ca. 0.8 seconds to form an electrostatic image of an elevated contact on the surface of said insulating layer. The measurements with a surface potential meter show a potential of −1400 V for Vp in FIG. 5, and a potential difference of ca. 400 V between $V_{LD}$ and $V_{LL}$, $V_{DD}$ and $V_{DL}$.

In the following there will be given an example in which the present invention is applied to a laser beam recording apparatus having an overlay function, for example for fixed formats, said apparatus being shown in FIGS. 13 and 14 respectively in a perspective view and a lateral cross-sectional view.

Figure 13:
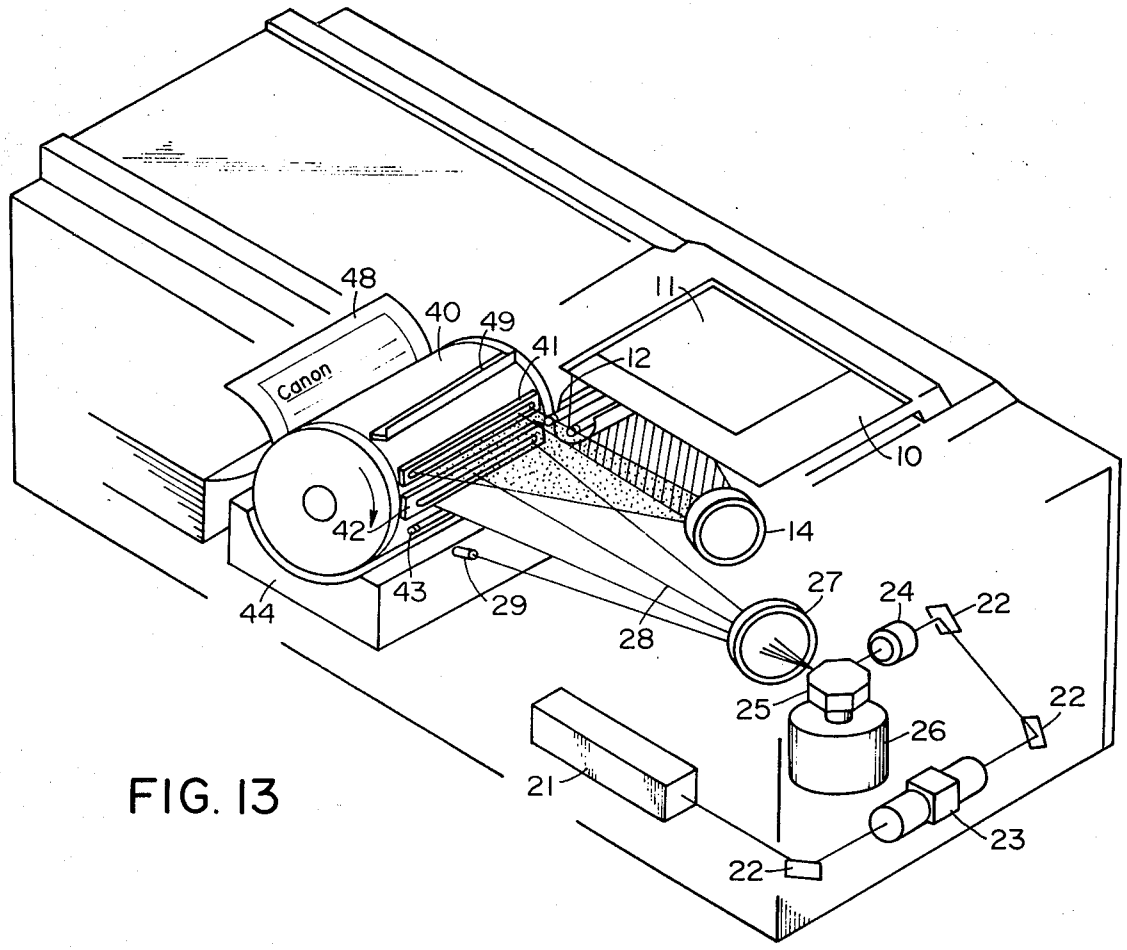
FIG. 13 is a perspective view of an embodiment of the electrophotographic apparatus of the present invention.
Figure 14:
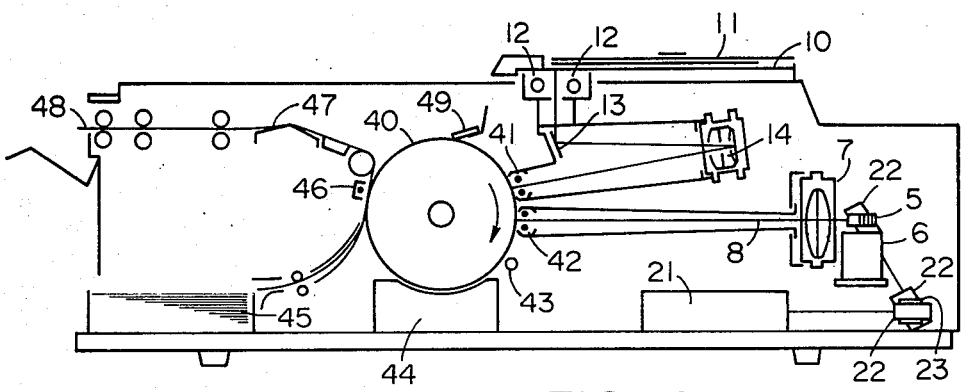
FIG. 14 is a lateral cross-sectional view of said apparatus.

Referring to FIGS. 13 and 14, an original 11, for example, for a fixed format is placed on an original carriage 10 movable in synchronization with the laser exposure as will be explained later, and is illuminated with an exposure lamp 12. The reflected light is directed by a mirror 13 to an original imaging lens 14 and is exposed as a first exposure, as will be explained later, onto a photosensitive drum 20.

A second exposure is achieved by a laser beam in synchronization with the first original exposure in a manner as explained in the following. The laser beam emitted by a laser oscillator 21 is guided through a mirror 22 to the entrance aperture of a deflector-modulator 23. Said mirror is employed for reducing the space in the apparatus and may be dispensed with if unnecessary. The deflector-modulator 23 is composed of an acousto-optical modulating element utilizing a known acousto-optical effect or an electro-optical modulating element utilizing a known electro-optical effect. The laser beam is intensity modulated and simultaneously deflected in said deflector-modulator 23 according to the input signals thereto.

The modulator 23 can be omitted in case of a semiconductor laser or in case there is employed another laser, for example a gas laser, of a type capable of current modulation or incorporating a modulating element in the oscillation optical path.

The laser beam from the modulator 23 is guided to a beam expander 24 which expands the diameter of said beam while maintaining the parallel state thereof. The laser beam of the thus expanded diameter is introduced to a rotary polygonal mirror 25 having one or plural mirror faces. Said polygonal mirror 25 is mounted on a shaft supported by a precision bearing, for example a pneumatic bearing, and is rotated by a constant-speed motor 26, for example a hysteresis synchronous motor or a DC servomotor, to perform a scanning operation in the horizontal direction. Said scanning operation may also be performed by a galvanometer mirror.

The laser beam put into horizontal scanning motion by said rotary polygonal mirror 25 is focused as a spot on a photosensitive drum 40 through an imaging lens 27 having a f-$\theta$ characteristic.

In an ordinary imaging lens the focus position r on the image plane is related to the incident angle $\theta$ of the beam by the following equation:

$$r = f \tan \theta \quad (1)$$

wherein f is the focal length of said lens. The incident angle to the lens 27 of the laser beam 28 reflected by the rotary polygonal mirror 25 of a constant speed as in the present embodiment changes linearly with the time, so that the displacing speed of the focused spot on the photosensitive drum 40 is not constant but shows a non-linear change, giving a higher displacing speed for a larger incident angle. Consequently, in response to the laser beam being turned on at a constant interval, the spots obtained on the photosensitive drum 40 becomes spaced wider on both sides of the drum than in the center thereof. In order to prevent such phenomenon the imaging lens is designed to have the following characteristic:

$$r=f\cdot\theta \quad (2)$$

and such lens is called an f-$\theta$ lens. Also in case of focusing a parallel beam into a spot with an imaging lens, the minimum spot diameter $d_{min}$ is given by the following equation:

$$d_{min}=f\lambda/A \quad (3)$$

wherein:

f: focal length of the imaging lens;

$\lambda$: wavelength of the light; and

A: incident aperture of the imaging lens;

so that a smaller spot diameter can be obtained for given values of f and $\lambda$ by increasing the value of A. The aforementioned beam expander is employed for this reason. Consequently said beam expansion can be dispensed with in case a desired value of $d_{min}$ is obtainable with the beam diameter of the laser oscillator. There is provided a beam detector 29 which is composed of a small entrance slit and a high-speed photoelectric transducer such as a PIN diode, which detects the position of the laser beam 28 in scanning motion thereby determining the timing for starting the input signals to said modulator 23 which provides desired optical information to the photosensitive drum. In this manner it is rendered possible to significantly reduce the aberration of signals in the horizontal direction resulting from eventual errors in the accuracy of reflecting faces of the rotary polygonal mirror 25 and also from eventual uneven rotation of said mirror, thereby improving the image quality, widening the tolerance required for the rotary polygonal mirror 25 and the drive motor 26, and permitting the lower manufacturing cost of the apparatus.

In the above-explained manner the photosensitive drum 40 is exposed to the laser beam 28 modulated by the external signals such as the second exposure, as will be explained later.

Now there will be explained the printing section of the apparatus shown in FIGS. 13 and 14. First, the photosensitive member 40 is essentially composed of a conductive substrate, a photoconductive layer and an insulating layer which is subjected to a first exposure of an original such as a fixed format through a primary corona discharger 41, substantially simultaneous with a negative charging of the surface of said insulating layer by means of said discharger 41. The area thus subjected to said first exposure of the photosensitive member, upon arrival at the position of an AC corona discharger 42 by rotation in the direction of arrow, is subjected to a second exposure by said laser beam in positional synchronization with said first exposure, substantially simultaneous with a charge elimination over the entire surface of said insulating layer by means of said AC corona discharger 42. Subsequently the entire surface of said insulating layer is exposed to the light from a lamp 43, whereby there is formed an overlaid electrostatic image having a potential difference between the area corresponding to the lighted area (white background) in the first exposure and also to the area not exposed to the laser beam in the second exposure and other areas. More specifically the area corresponding to the lighted area in the first exposure and also to the dark area in the second exposure has a negative charge on the surface of said insulating layer while in other areas said surface is maintained at a substantially zero potential. Subsequently said overlaid electrostatic image is rendered visible in a developing unit 44 by reversal development with a developer principally composed of negatively charged colored particles, and the thus obtained visible image is transferred onto a transfer material 45 such as a paper sheet under the influence of an internal or external field 46, and is fixed by fixing means 47 such as an infrared lamp, a hot plate or a pressure fixing device to obtain an electrophotographic print. On the other hand the photosensitive member 40 is subjected, after the image transfer, to a cleaning step for removing the remaining charged particles from the surface of said insulating layer by cleaning means 49 and thus is prepared for repeated use in the succeeding imaging cycle.

In the foregoing embodiment, the reversal development causes the deposition of charged particles on the area corresponding to the dark area in the first exposure, also on the area corresponding to the lighted area in the first exposure, and also to the dark area in the second exposure, as shown in FIG. 7. For this reason it is made possible to use an easily preparable positive original for said first exposure, and to employ the already known control method of the laser beam recording apparatus for the laser signal control in the second exposure.

Also the foregoing embodiment has been explained by an application thereof to a laser beam recording apparatus having an overlay function, for example for a fixed format, but it is also applicable to other apparatus having a similar overlay function, such as an apparatus utilizing a cathode ray tube in place of the laser or an apparatus composed of an electrophotographic copier and a microfilm blow up printer.

Now there will be explained the method of achieving positional synchronization or registration between the first exposure and the second exposure. Such synchronization is naturally unnecessary in certain cases, for example when the first or second exposure is utilized for making repetitive background patterns.

The first and second exposures to be synchronized may appear in the following combinations:

(1) First exposure by the light reflected from an original, and second exposure by a laser beam;

(2) First and second exposures by the lights reflected from originals;

(3) First and second exposures by laser beams; and (4) First exposure by laser beam; and second exposure by the light reflected from an original.

Naturally the light reflected from an original may be replaced by a light transmitted from a transparent film or an enlarged light from a microfilm original, and the laser beam may be replaced by other spot-forming beams, for example from a cathode ray tube.

The synchronizing methods in these four combinations will be explained in the following. First, the combination (1) corresponds to the apparatus of the foregoing embodiment.

Figure 15:
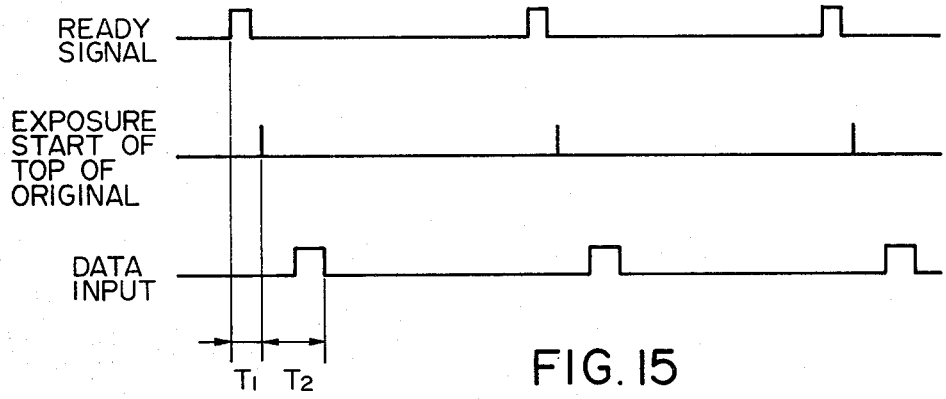
FIGS. 15 and 16 are time-charts showing the synchronizing systems, respectively, for the first and second image-forming exposures in the above-mentioned embodiment of the present invention.

Referring to FIGS. 13 and 14, the original carriage 10 displacing at a constant speed actuates an unrepresented microswitch at a predetermined position to generate a ready signal as shown in FIG. 15. The exposure of the leading end of the original is initiated after a determined time $T_1$, and thereafter the exposure with the laser beam is initiated in response to the data signal after a controlled time $T_2$.

The time $T_2$ from start of exposure of leading end of the original to the start of laser beam exposure is given by:

$$T_2=(E_2-E_1)/v_p$$

wherein $E_2-E_1$: distance between the first and second exposure positions $v_p$: the peripheral speed of the photosensitive drum.

The time chart in this case is shown in FIG. 15. The time $T_1$ is determined mechanically by the relation between the position of the switch for generating the ready signal and the position of the leading end of the original, while the time $T_2$ is determined electrically, for example by a known counting means.

The following explains an example of the synchronizing method in the case (2) wherein the first and second exposures are both made with lights reflected from originals.

Figure 17:
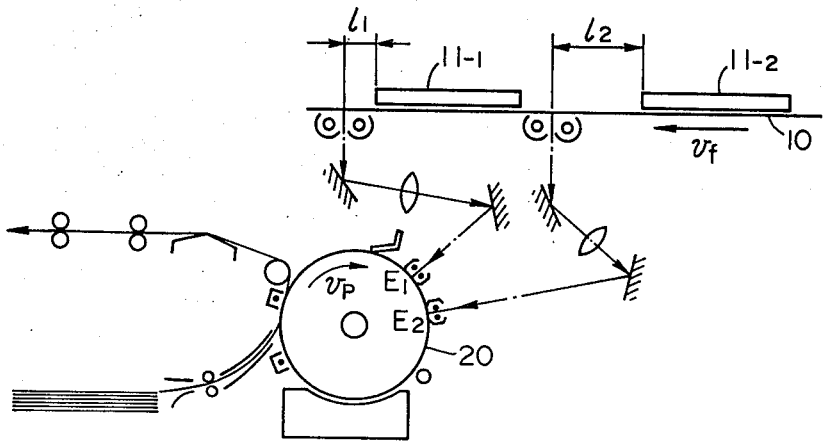
FIGS. 17 and 18 are explanatory views showing two examples of said synchronizing system.

Referring to a structure shown in FIG. 17, the positional synchronization of the first and second originals can be achieved if the following relationship is selected between the leading end positions of the first and second originals 11-1, 11-2 and the first and second exposure positions E1, E2 onto the photosensitive drum:

$$(l_2-l_1)/v_f=(E_2-E_1)/v_p$$

wherein $l_1$: distance of displacement of original carriage before reaching a constant-speed displacement or a larger distance $l_2-l_1$:distance between leading ends of first and second originals $v_f$: speed of original carriage $v_p$: peripheral speed of photosensitive drum $E_2-E_1$:distance between first and second exposure positions.

The above-mentioned synchronized displacements can be achieved by already known means.

Now there will be shown an example of a synchronizing method in the case (3) wherein the first and second exposures are both conducted by laser beams. In this case the synchronization can be achieved by initiating the second laser exposure after a time T2 from the first laser exposure, said time $T_2$ being electrically determined so as to satisfy the following equation:

$$T_2=(E_2-E_1)/V_p$$

wherein $E_2-E_1$: distance between the first and second exposure positions; and $v_p$: peripheral speed of photosensitive drum.

The following explains an example of the synchronizing method in the case (4) in which the first exposure is achieved with a laser beam while the second exposure is conducted with the light reflected from an original.

Figure 16:
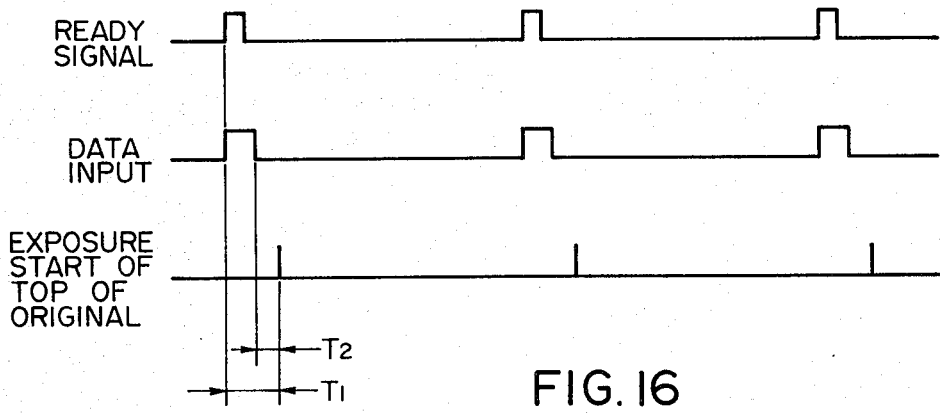
Figure 18:
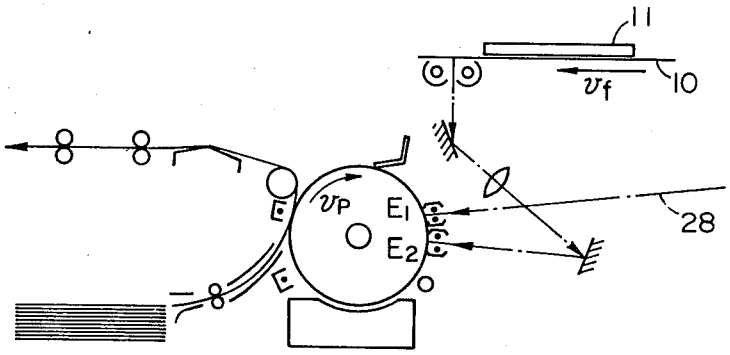

Referring to FIG. 18, the original carriage 10 displaced at a constant speed generates a ready signal at a predetermined position as shown in FIG. 16. After a controlled time therefrom, the exposure with the laser beam 28 is initiated in response to the entered data signals. Also the time is controlled in such a manner that the exposure of the leading end of the original 11 is initiated when the initially laser-exposed portion of the photosensitive drum is rotated to the second exposure position by the light reflected from the original. Thus the time $T_2$ from the start of data signals to the laser to the start of exposure of the leading end of the original 11 is represented by:

$$T_2=(E_2-E_1)/v_p$$

wherein $E_2-E_1$: distance between the first exposure position with laser beam and the second exposure position at which the exposure of the leading end of the original is initiated; and $v_p$: peripheral speed of the photosensitive drum.

Also the time $T_1$ from the ready signal to the start of exposure of the leading end of the original is given by:

$$T_1=(l_r-f)/vf$$

wherein $l_r-f$: distance from the switch position for generating the ready signal to the leading end position of the original; and $v_f$: displacing speed of the original carriage.

Said ready signal can be obtained for example from a microswitch positioned so as to be actuated by the displacement of the original carriage.

As will be apparent from the time chart shown in FIG. 16, the timing of the data signal supply is controlled so as to be synchronized with the start of exposure of the leading end of the original by regulating the time $T_1$ and $T_2$, namely from the ready signal to the start of exposure with the laser beam or to the start of exposure of the leading end of the original.

In the foregoing there has been given a brief explanation of the synchronizing methods for the first and second images.

Embodiment 2

Figure 21:
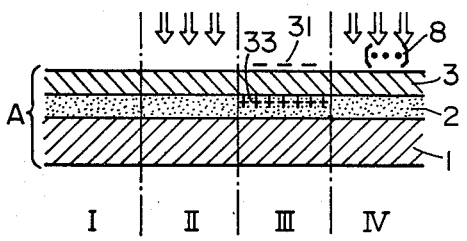
Figure 22:
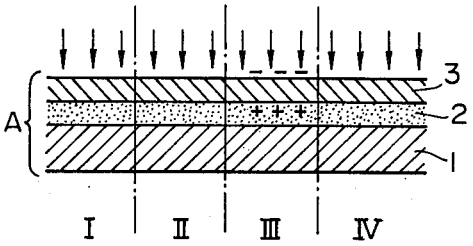
Figure 23:
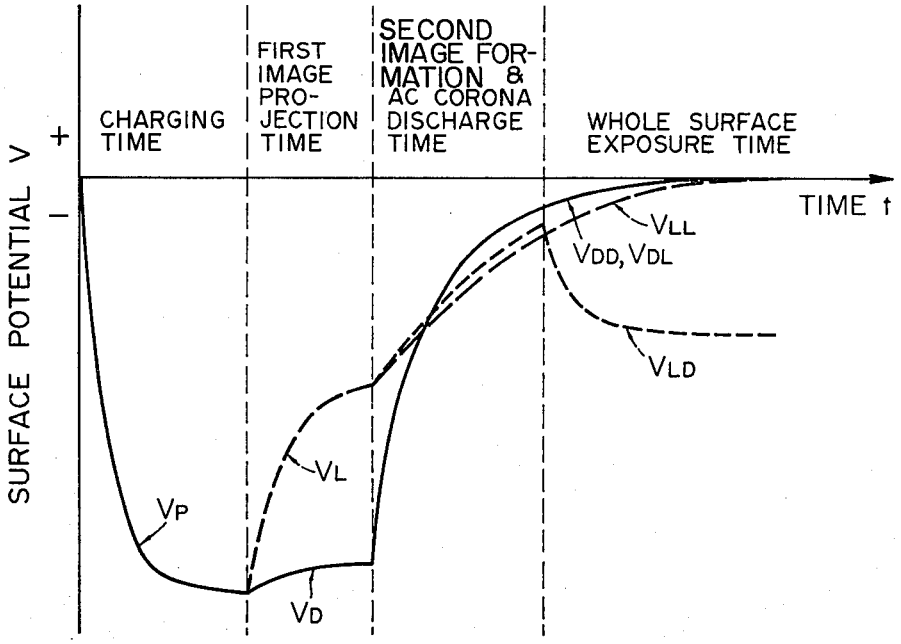
FIG. 23 is a chart showing the change of the surface potential in the steps shown in FIGS. 19 to 22.

FIGS. 19 to 23 illustrate the second embodiment of the present invention, wherein FIGS. 19 to 22 show the steps corresponding to those of the first embodiment shown in FIGS. 2 to 4 while FIG. 23 correspond to FIG. 5, in which common components are represented by common numbers. Said second embodiment features, in comparison with said first embodiment, a modification that the exposure to the first image-forming irradiation is conducted immediately after the uniform charging of the surface of the insulating layer of the photosensitive member.

Figure 19:
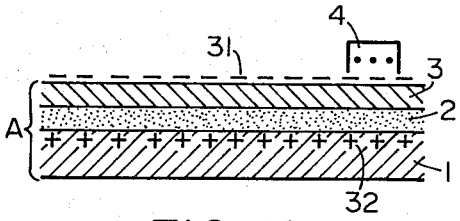
FIGS. 19 to 22 are explanatory views showing the steps of a second embodiment of the present invention.

Referring to FIG. 19, the insulating layer 3 of the photosensitive member A is charged on the surface, for example negatively, in a dark place with the corona discharger 4, whereby, a positive charge 32 is induced at the interface between the conductive substrate 1 and the photoconductive layer 2 or in a portion of said photoconductive layer 2 close to said interface because of a high dark resistance of said photoconductive layer 2. In this step the surface potential of the insulating layer 3 increases negatively with the charging time as shown by the curve $V_p$ in FIG. 23. Said charging may naturally be conducted with an electrode in place of said corona discharger.

Figure 20:
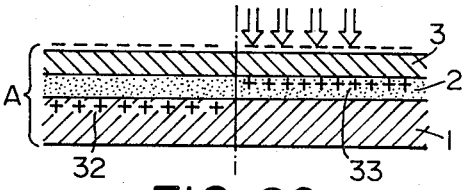

Subsequently the first light image is irradiated onto the surface of said insulating layer 3. In the lighted area of the photosensitive member A, the photoconductive layer 2 is rendered electroconductive by the light stimulation, whereby the positive charge 32 induced by the foregoing charging step at the interface between the conductive substrate 1 and the photoconductive layer 2 or in a portion of said layer 2 close to said interface migrates to and is maintained at the interface between said photoconductive layer 2 and the insulating layer 3 by the attractive force of the negative charge present on the surface of said insulating layer 3, while in the dark area the state of charges remains unchanged because of the high resistance of the photoconductive layer 2 as shown in FIG. 20. During this step the surface potentials of the insulating layer 3 in the lighted and dark areas show changes as respectively represented by the curves $V_L$ and $V_D$ in FIG. 23.

Subsequently the photosensitive member is exposed to the second image-forming irradiation substantially simultaneous with an AC corona discharge subjected to the surface of said insulating layer 3 by the AC corona discharger 8, as shown in FIG. 21.

In order to conduct said image irradiation substantially simultaneous with the discharge, said AC corona discharger 8 is preferably provided with an optically open upper structure having a transparent shield or without any shield.

In this step the negative charge present on the surface of the insulating layer 3 and in the areas I and II corresponding to the dark area in the first exposure is entirely or almost entirely dissipated because of the absence of a binding force thereon.

Also in the area IV corresponding to the lighted area in the second exposure, the photoconductive layer 2 renders the positive charge 33 trapped at the interface between said layer 2 and the insulating layer 3 easily releasable toward the conductive substrate 1, whereby the negative charge 31 present on the surface of said insulating layer 3 loses the binding force and is dissipated entirely or almost entirely together with said positive charge 33. The amount of such dissipation depends on the time and intensity of the AC corona discharge.

On the other hand in the area III corresponding to the lighted area in the first exposure and also to the dark area in the second exposure the photoconductive layer 2 retains a high resistance to prohibit the release of the positive charge 33 to the conductive substrate 1, whereby the negative charge 31 on the surface of said insulating layer 3 is bound by said positive charge 33 and is discharged by the AC corona discharge only to an extent significantly less than in the area I corresponding to the dark area in the first exposure or in the areas II and IV corresponding to the lighted area in the second exposure.

In this manner the area III corresponding to the lighted area in the first exposure and also to the dark area in the second exposure retains a significant amount of negative charge on said insulating layer 3, but the external electric field resulting therefrom is extremely weak since an elevated amount of positive charge trapped in the photoconductive layer 2 attracts the electric field caused by said negative charge.

Subsequently the photosensitive member is exposed uniformly to light over the entire surface thereof through said insulating layer 3, or through the conductive substrate in case it is made of a translucent material, as shown in FIG. 22.

In the areas I, II and IV corresponding to the dark area in the first exposure or to the lighted area in the second exposure, the surface potential of said insulating layer 3 remains almost zero as shown in FIG. 20 since there is no substantial change in the charges in the photoconductive layer 2. However in the area III corresponding to the lighted area in the first exposure and also to the dark area in the second exposure, the photoconductive layer 2 which has been maintained in the high resistance state because of the absence of light exposure in the second exposure step reduces the resistance rapidly by the whole surface exposure, so that the positive charge 33 trapped in said layer is dissipated to the conductive substrate 1 save an amount corresponding to the negative charge 31 present on the insulating layer 3, whereby the external field resulting from said negative charge 31 is rapidly increased to elevate the surface potential thereof as shown in FIG. 22.

During the above-mentioned step, the surface potential of the insulating layer 3 shows the changes as illustrated in FIG. 23. The area III corresponding to the lighted area of the first exposure and also to the dark area of the second exposure alone shows a high negative potential $V_{LD}$, while other areas I, II and IV show the potentials $V_{DD}$, $V_{DL}$ and $V_{LL}$ approximately equal to zero.

It is therefore possible to obtain an overlaid visible image of said first and second images by developing the photosensitive member A in this state with a toner material, in a similar manner as explained in connection with the first embodiment.

The method of utilizing the thus prepared overlaid latent image and the possibility of using the reflected light and the laser beam in the formation of said latent image in this second embodiment will not be explained in detail, as it will be readily understood by those skilled in the art that the foregoing description made in connection with FIG. 6 and thereafter relating to the first embodiment is also applicable to this second embodiment, except that the first exposure is preceded by the primary charging.

Embodiment 3

Figure 24:
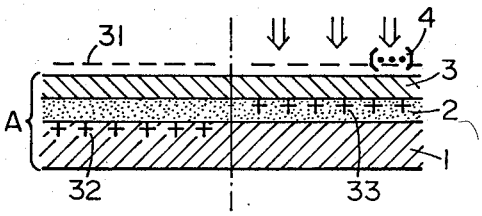
FIGS. 24 to 26 are explanatory views showing the steps of a third embodiment of the present invention.
Figure 25:
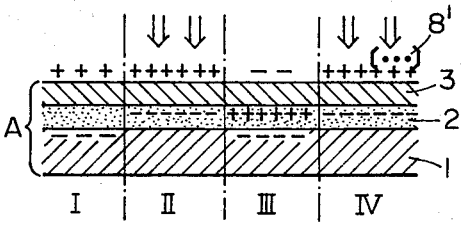
Figure 26:
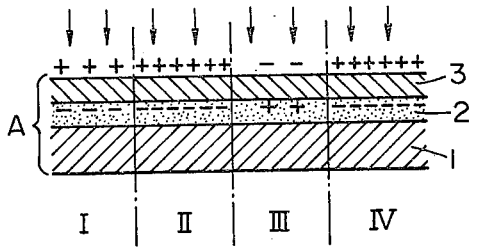
Figure 27:
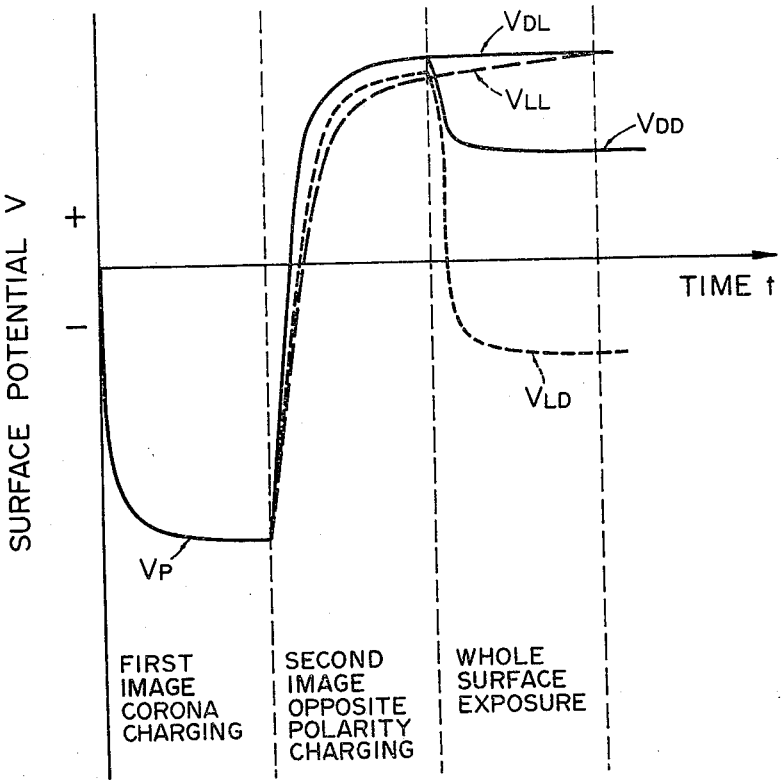
FIG. 27 is a chart showing the change of the surface potential in the steps shown in FIGS. 24 to 26.

FIGS. 24 to 27 illustrate the third embodiment of the present invention, wherein FIGS. 24 to 26 show the steps corresponding to those of the first embodiment shown in FIGS. 2 to 4 while FIG. 27 corresponds to FIG. 5, in which common components are represented by common numbers. Said third embodiment is featured, in comparison with said first embodiment, by a modification that a secondary charging of a polarity opposite to that of the primary charging is conducted simultaneously with the second exposure to the second image-forming irradiation.

Referring to FIG. 24, the insulating layer 3 of the photosensitive member A is charged on the surface, for example negatively, with the primary corona discharger 4 substantially simultaneous with the irradiation of the first image. In the dark area wherein the photoconductive layer 2 has a high resistance, there is induced a positive charge 32 at the interface between the conductive substrate and said layer 2 or in a portion thereof close to said interface. In the lighted area the photoconductive layer 2 is rendered electroconductive by the light stimulation, whereby a positive charge is injected from the conductive substrate 1 and attracted by the negative charge on said insulating layer to the interface between said photoconductive layer 2 and said insulating layer 3, as shown in FIG. 24. In this step the surface potential of the insulating layer 3 negatively increases with the charging time as represented by the curve $v_p$ in FIG. 27.

Subsequently and substantially simultaneous with the irradiation of the second light image, a corona discharge of a positive polarity, which is opposite to that of said primary charging, is given to the surface of said insulating layer 3 by the corona discharger 8'.

In order to perform a corona discharge of a polarity opposite to that of said primary corona discharger 4 substantially simultaneous with the irradiation of the second light image, said corona discharger 8' is preferably provided with an optically open upper structure with or without a transparent shield.

In the areas I and II corresponding to the dark area in the first exposure, the negative charge 31 on the insulating layer 3 is neutralized by the positive charge provided by the secondary charging, whereupon said insulating layer 3 is recharged into the polarity of said secondary charging.

Also in the area IV corresponding to the lighted area both in the first and second exposures, the negative charge generated by the primary charging on said insulating layer is neutralized by the positive charge provided in the secondary charging, whereupon said insulating layer is recharged into the polarity (positive) of said secondary charging. Also in this step the photoconductive layer 2 is rendered electroconductive whereby the positive charge formed at the interface between said layer 2 and the insulating layer 3 by the primary charging is liberated and dissipated, and a negative charge is induced therein by the positive charge present on the insulating layer 3.

The amounts of these charges depend upon the time and intensity of said secondary charging.

On the other hand in the area III corresponding to the lighted area in the first exposure and also to the dark area in the second exposure, the negative charge formed on the insulating layer 3 by the primary charging is only partially neutralized by the positive charge provided in the secondary charging or only partially recharged positively after complete neutralization of said negative charge. This is presumably due to the fact that the positive charged layer formed at the interface between the photoconductive layer 2 and the insulating layer 3 by the first image exposure following the primary charging is not released even after the recharging because of the presence of a blocking layer at the surface of the photoconductive layer and also because of the high resistance of the photoconductive layer 2, whereby the electric field generated by said positive charge suppresses the recharging on the surface of the insulating layer 3 (see FIG. 25).

Subsequently the photosensitive member having the above-mentioned electrostatic image is uniformly exposed to light over the entire surface thereof through the insulating layer.

In the areas I, II and IV corresponding to the dark area in the first exposure or to the lighted area in the second exposure, the positive charge present on the insulating layer, being stably maintained in combination with the negative charge at the lower surface of said insulating layer, is not significantly dissipated to maintain a substantially constant surface potential.

However in the area III corresponding to the lighted area in the first exposure and also to the dark area in the second exposure, the photoconductive layer which has been maintained in the high-resistance state because of the absence of light exposure in the preceding step becomes rapidly electroconductive by the light exposure in this step, whereby the positive charge trapped at the interface with the photoconductive layer 2 is dissipated to rapidly reduce the surface potential of said insulating layer. Also in case the negative charge formed in the primary charging is not completely neutralized by the positive charge provided in the recharging, there appears not only the reduction in the surface potential but also a surface potential induced by the remaining negative surface charge (cf. FIG. 26). In the foregoing steps the surface potential of the insulating layer 3 assumes the behavior as shown in FIG. 27.

The electrostatic image obtained in the above-explained manner is rendered visible as already explained in the foregoing with a developer material principally composed of charged colored particles in a known developing method such as the magnet brush development or the cascade development.

Figure 28:
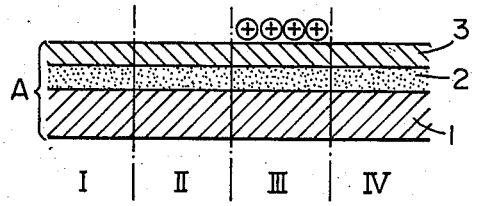
FIGS. 28 and 29 are explanatory views showing the development steps.
Figure 29:
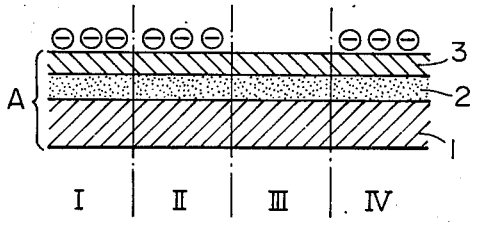

FIG. 28 shows a case of development with toner particles of positive polarity which is opposite to that of said primary charging, wherein the toner particles are deposited in the area III corresponding to the lighted area in the first exposure and also to the dark area in the second exposure, while FIG. 29 shows a case of reversal development with toner particles of negative polarity which is the same as that of said primary charging, wherein the toner particles are deposited in the areas I, II and IV.

In the following there will be given a quantitative example of the foregoing third embodiment.

100 grs. of cadmium sulfide activated with copper is added with 10 grs. of vinyl chloride and mixed with a small amount of thinner to obtain a photosensitive material, which is coated in a thickness of ca. 50 microns on a surface-polished aluminum cylinder. Subsequently an insulating layer of a thickness of 35 microns is laminated thereon to obtain a photosensitive member.

Said insulating layer of the thus obtained photosensitive member is exposed to a corona discharge of $+6.5$ kV, and substantially simultaneous to a first light image with an intensity of ca 12 lux for 0.3 seconds in the lighted area. Subsequently the photosensitive member is exposed by recharging with a corona discharge of $-6$ KV and substantially simultaneous to a second light image of the same intensity as mentioned above, and then the whole surface of the photosensitive member is uniformly exposed to a light of ca. 12 lux for 0.8 seconds to form an electrostatic image. The measurements with a surface potential meter show a potential of $-1400$ V for $V_P$ in FIG. 27, and a potential difference of ca 400 V between $V_{LD}$ and $V_{LL}$, $V_{DD}$ and $V_{DL}$.

Embodiment 4

Figure 34:
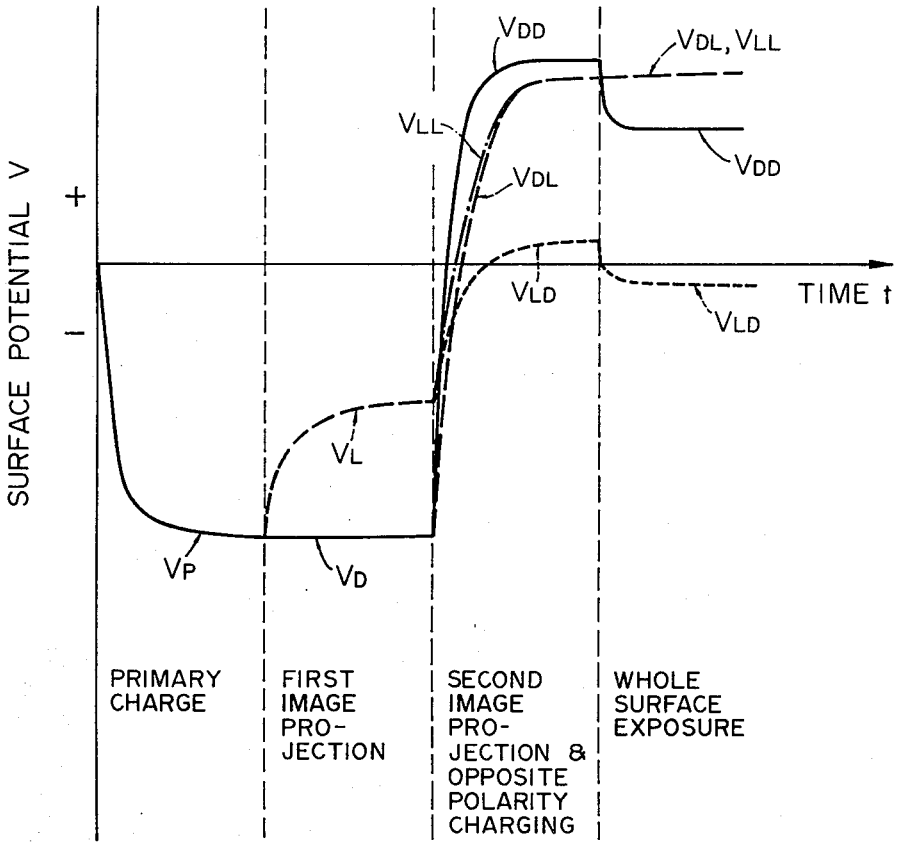
FIG. 34 is a chart showing the change of the surface potential in the steps shown in FIGS. 30 to 33.

FIGS. 30 to 34 illustrate the fourth embodiment of the present invention, wherein FIGS. 30 to 33 show the steps corresponding to those of the third embodiment shown in FIGS. 24 to 26 while FIG. 34 corresponds to FIG. 27, in which common components are represented by common numbers. Said fourth embodiment features, in comparison with said third embodiment, a modification that the exposure to the first image-forming irradiation is conducted immediately after the uniform charging of the surface of the insulating layer of the photosensitive member.

Figure 30:
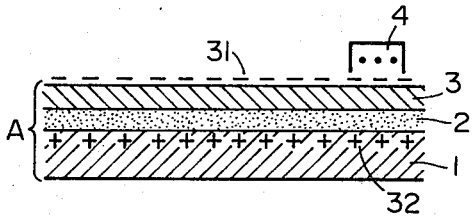
FIGS. 30 to 33 are explanatory views showing the steps of a fourth embodiment of the present invention.

First the insulating layer 3 of the photosensitive member A is charged on the surface, for example negatively in a dark place with the corona discharger 4, whereby a positive charge 32 being induced at the interface between the conductive substrate 1 and the photoconductive layer 2 or in a portion of said layer 2 close to said interface because of a high dark resistance of said photoconductive layer 2 as shown in FIG. 30. In this step the surface potential of the insulating layer 3 negatively increases with the charging time as represented by the curve $V_P$ in FIG. 34. Said charging may naturally be conducted with an electrode in place of said corona discharger.

Figure 31:
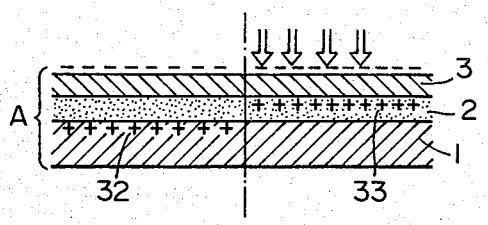
Figure 32:
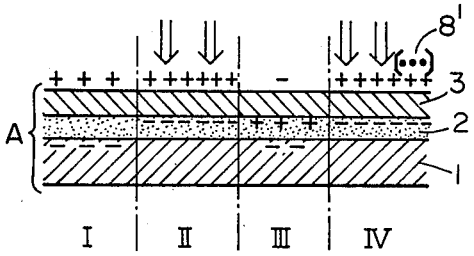
Figure 33:
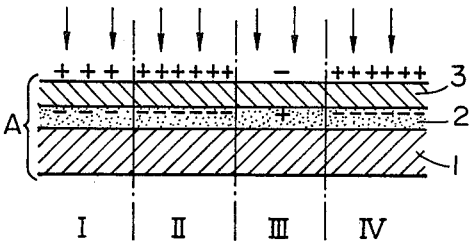

Subsequently the first light image is irradiated onto the surface of said insulating layer 3. In the lighted area of the photosensitive member A, the photoconductive layer 2 is rendered electroconductive by the light stimulation, whereby the positive charge 32 induced by the foregoing charging step at the interface between the conductive substrate 1 and the photoconductive layer 2 or in a portion of said layer 2 close to said interface migrates to and is maintained at the interface between said photoconductive layer 2 and the insulating layer 3 by the attractive force of the negative charge present on the surface of said insulating layer 3, while in the dark area the state of charges remains unchanged because of the high resistance of the photoconductive layer 2 as shown in FIG. 31. During this step the surface potentials of the insulating layer 3 in the lighted and dark areas show changes as respectively represented by the curves $V_L$ and $V_D$ in FIG. 34.

Subsequently the photosensitive member A is exposed to the second image-forming irradiation substantially simultaneous with a recharging with the corona discharger 8' of the positive polarity which is opposite to the polarity of the foregoing primary charging.

In order to perform the discharge operation substantially simultaneous with the image exposure, said corona discharger and secondary corona discharger 8' are preferably provided with an optical open upper substructure having a transparent shield or without any shield.

In the areas I and II corresponding to the dark area in the first exposure, the negative charge 31 present on the insulating layer 3 is neutralized by the positive charge provided by the recharging, and said insulating layer 3 in said area is recharged further in the positive polarity which is the same as the polarity of said recharging. Also in the area IV corresponding to the lighted areas both in the first and second exposure, the negative charge generated on the insulating layer 3 by the primary charging is neutralized by the positive charge provided in the recharging and said insulating layer 3 is further recharged in the polarity (positive) of said recharging. Also in this step the photoconductive layer 2 is rendered conductive by the light irradiation, so that the positive charge formed by the primary charging at the interface between said layer 2 and the insulating layer 3 is liberated and dissipated, and a negative charge is induced therein by the positive charge provided on the surface of said insulating layer 3.

The amounts of these charges depend on the time and intensity of the recharging.

On the other hand, in the area III corresponding to the lighted area in the first exposure and also to the dark area in the second exposure, the negative charge is only partially formed on the insulating layer 3 by the primary charging with the positive charge provided by the recharging, or is recharged only to a limited extent even in the case of complete neutralization. This phenomenon is presumably due to the fact that the positive surface layer formed at the interface between the photoconductive layer 2 and the insulating layer 3 by the first image exposure following the primary charging is not released even after the recharging because of the presence of a blocking layer at the surface of the photoconductive layer and also because of the high resistance of the photoconductive layer 2, whereby the electric field generated by said positive charge suppresses the recharging on the surface of the insulating layer 3 (see FIG. 32).

Subsequently the photosensitive member having the above-mentioned electrostatic image is uniformly exposed to light over the entire surface thereof through the insulating layer.

In the areas I, II and IV corresponding to the dark area in the first exposure or to the lighted area in the second exposure, the positive charge present on the insulating layer, being stably maintained in combination with the negative charge at the lower surface of said insulating layer, is not significantly dissipated, thereby maintaining a substantially constant surface potential.

However in the area III corresponding to the lighted area in the first exposure and also to the dark area in the second exposure, the photoconductive layer which has been maintained in the high-resistance state because of the absence of light exposure in the preceding step becomes rapidly electroconductive by the light exposure in this step, whereby the positive charge trapped at the interface with the photoconductive layer 2 is dissipated to rapidly reduce the surface potential of said insulating layer. Also in case the negative charge formed in the primary charging is not completely neutralized by the positive charge provided in the recharging step, there appears not only the reduction in the surface potential but also a surface potential induced by the remaining negative surface charge (cf. FIG. 33). In these steps the surface potential of the insulating layer 3 assumes the behavior as shown in FIG. 34.

The electrostatic image obtained in the above-explained manner is rendered visible as already explained in the foregoing embodiments with a developer material principally composed of charged colored particles in a known developing method such as the magnet brush development or the cascade development.

The foregoing third and fourth embodiments are also applicable to the process and apparatus similar to those explained in connection with FIGS. 13 to 18 with certain modifications, but such application will not be explained in detail as it will be readily understood by those skilled in the art that these third and fourth embodiments can be considered as modifications of the first embodiment detailedly explained in the foregoing.

Also the present invention is not limited to the foregoing embodiments, but naturally includes various modifications within the scope and spirit of the present invention. For example the exposure to the second image forming irradiation can be conducted immediately prior to the secondary charging or the AC charge elimination.

As explained in the foregoing, the present invention, featuring an overlay process and an apparatus adapted therefor for forming an overlaid electrostatic latent image from positionally synchronized first and second images, provides various overlay latent images from various combinations of the first and second images and utilizes the first and second steps of the latent image forming process, thus allowing adaptation of the image forming apparatus to a wide range of applications and being extremely advantageous in the overlay recording of various data and information.

What we claim is:

1. A process for forming an overlay latent image, comprising the steps of:

(a) charging, with a predetermined polarity, the surface of an insulating layer of a photosensitive member essentially composed of a conductive substrate, a photoconductive layer having a property of rejecting the injection thereinto of charge of a polarity opposite to the predetermined polarity in the dark, and said insulating layer;

(b) providing said photosensitive member with a first image-forming irradiation actinic to said photoconductive layer substantially simultaneous with or subsequent to said charging, so that the charge of said opposite polarity is substantially injected into the photoconductive layer at a light area of the first image, but the charge is not injected at a dark area of the first image;

(c) providing the surface of the insulating layer of said photosensitive member, after said irradiation, with a corona discharge having a component of corona ions opposite in polarity to the polarity of charging applied on the insulating surface during said charging step, and further providing a second image-forming irradiation actinic to said photoconductive layer substantially simultaneous with said corona discharge, wherein said first and second images are different; and (d) providing the entire surface of said photosensitive member with a uniform irradiation actinic to said photoconductive layer of said member, thereby forming an overlay latent image of said first and second images on the surface of said insulating layer.

2. A process according to claim 1, wherein said first and second images are positionally synchronized to form the electrostatic latent image.

3. A process according to claim 1, wherein said first image-forming irradiation is provided by an optical image of an original, while said second image-forming irradiation is provided by an optical beam spot modulated by a recording signal and deflected by a scanning optical system.

4. A process according to the claim 1, wherein said first and image-forming irradiations are respectively provided by optical images of originals.

5. A process according to claim 1, wherein said first image-forming irradiation is provided by an optical beam spot modulated by a recording signal and deflected by a scanning optical system, while said second image-forming irradiation is provided by an optical image of an original.

6. A process according to claim 1, wherein said first and second image-forming irradiations are provided by optical beam spots modulated by a recording signal and deflected by a scanning optical system.

7. A process according to claim 1, wherein said corona discharging step is effected by an AC corona discharger.

8. A process according to claim 1, wherein said corona discharging step is effected by a corona discharger of a polarity opposite to said predetermined polarity.

9. A process according to claim 1, wherein said overlay latent image is developed with toner of a polarity which is the same as said predetermined polarity.

10. A process according to claim 9, wherein the toner is deposited on the dark portion of the first image and the light portion of the second image.

11. A process according to claim 1, wherein said overlay latent image is developed with toner of a polarity which is opposite to said predetermined polarity.

12. A process according to claim 11, wherein the toner is deposited on the light portion of the first image and the dark portion of the second image.

* * * * *

UNITED STATES PATENT AND TRADEMARK OFFICE

CERTIFICATE OF CORRECTION

PATENT NO. : 4,469,767

DATED : September 4, 1984

INVENTOR(S) : TAKASHI KITAMURA, ET AL.

It is certified that error appears in the above-identified patent and that said Letters Patent is hereby corrected as shown below:

On the title page;

In the Title, "OVERPLAY" should read --OVERLAY--.

COLUMN 1

Line 2, "OVERPLAY" should read --OVERLAY--.

Signed and Sealed this

*Twentieth* Day of *August 1985*

[SEAL]

*Attest:*

DONALD J. QUIGG

*Attesting Officer* *Acting Commissioner of Patents and Trademarks*